US006631784B2

(12) United States Patent
Hieb et al.

(10) Patent No.: US 6,631,784 B2
(45) Date of Patent: Oct. 14, 2003

(54) DEVICE FOR REDUCING NOISE EMISSIONS

(75) Inventors: Christian Hieb, Neuhofen (DE); Daniel Conzelmann, Dielheim (DE); Günter Stephan, Wiesloch (DE)

(73) Assignee: Heidelberger Drucksmaschinen AG, Heidelberg (DE)

( * ) Notice: Subject to any disclaimer, the term of this patent is extended or adjusted under 35 U.S.C. 154(b) by 140 days.

(21) Appl. No.: 09/775,035

(22) Filed: Feb. 1, 2001

(65) Prior Publication Data

US 2001/0020424 A1 Sep. 13, 2001

(30) Foreign Application Priority Data

Feb. 1, 2000 (DE) ..... 100 04 205

(51) Int. Cl.[7] ..... G10K 11/04

(52) U.S. Cl. ..... 181/200; 181/205; 101/232; 101/480; 101/216

(58) Field of Search ..... 181/200, 205, 181/207, 208, 209, 211; 101/232, 216, 480; 400/689, 690

(56) References Cited

U.S. PATENT DOCUMENTS

| | | | | | |
|---|---|---|---|---|---|
| 4,336,862 | A | * | 6/1982 | Adam et al. | 181/200 |
| 4,943,173 | A | * | 7/1990 | Okazaki et al. | 181/201 |
| 5,121,811 | A | * | 6/1992 | Shima et al. | 181/201 |
| 5,158,378 | A | * | 10/1992 | Takada et al. | 400/690 |
| 5,669,725 | A | * | 9/1997 | Koshiishi et al. | 400/689 |
| 6,408,747 | B2 | * | 6/2002 | Koppelkamm et al. | 101/147 |

FOREIGN PATENT DOCUMENTS

| | | | | | |
|---|---|---|---|---|---|
| DE | 7 325 088 | | | 10/1973 | |
| DE | 34 23 272 | A1 | | 1/1986 | |
| DE | 297 18 302 | U1 | | 6/1998 | |
| DE | 198 03 809 | A1 | | 8/1999 | |
| JP | 62073980 | A | * | 4/1987 | B41J/29/08 |
| JP | 01097674 | A | * | 4/1989 | B41J/29/08 |
| JP | 02185479 | A | * | 7/1990 | B41J/29/13 |
| JP | 03000277 | A | * | 1/1991 | B41J/29/08 |
| JP | 03002063 | A | * | 1/1991 | B41J/11/02 |
| JP | 03155972 | A | * | 7/1991 | B41J/29/08 |
| JP | 05309913 | A | * | 11/1993 | B41J/29/08 |
| JP | 06001039 | A | * | 1/1994 | B41J/29/08 |

* cited by examiner

*Primary Examiner*—Robert E. Nappi
*Assistant Examiner*—Edgardo San Martin
(74) *Attorney, Agent, or Firm*—Laurence A. Greenberg; Werner H. Stemer; Gregory L. Maybeck

(57) ABSTRACT

A device for reducing the noise emissions of a machine for printing flat material, wherein flat material is transportable across an impression cylinder, comprising at least one muffling element disposed across a portion of a transport path of the flat material extending along the impression cylinder, directly behind or downline from a nip, as viewed in the direction of the transport path, and at a spaced distance from the impression cylinder; and a machine including the device.

19 Claims, 4 Drawing Sheets

DEVICE FOR REDUCING NOISE EMISSIONS

BACKGROUND OF THE INVENTION

Field of the Invention

The invention relates to a device for reducing noise emissions of a machine for printing flat materials, particularly a rotary printing machine wherein the flat materials are transportable over an impression cylinder.

Printing machines of this type, particularly offset printing machines, generate noise in the region of the impression cylinder in printing the flat material and emit this noise into the environment. In this regard, so-called paper-tearing noise is involved, a noise which arises in the printing of paper sheets which are used as flat printing material when they are through-transported between an impression cylinder and an ink applicator element, namely a rubber blanket cylinder, and when they disengage from the ink depositing element. It is possible to reduce noise by primary measures only to a limited extent. But because excessive noise emission from the printing machine is uncomfortable or even hazardous to the operating personnel, the dispersal of airborne noise must be minimized by secondary noise insulation measures. Muffling, on one hand, and damping, on the other hand, are secondary sound insulation measures that come into consideration. Muffling is the conversion of sound energy into heat; it is accomplished by using fibrous or porous absorption materials. Damping is the blocking of sound dispersal; for airborne noise it is preferably achieved by using baffles. Heretofore, the noise arising during the printing of flat material has not been purposefully counteracted as such, but rather only in the context of general sound insulation measures affecting the overall printing unit.

In the German Published Non-prosecuted Patent Application (DE-OS) 34 23 272 A1, a sheet offset printing machine is disclosed including a conveyor mechanism for paper sheets in the form of a chain conveyor having noise emissions which are reduced by using a muffler and a partial encapsulation at the top and bottom sides. The printing machine comprises printing units that have pivoting protective plastic hoods. The protective hoods form an outer cover for the respective printing unit and make it possible to access the elements of the unit easily by swinging the hoods away. In addition, other units of the printing machine such as the drive, delivery and feeder, and the footstep are encapsulated and are constructed damped and, if necessary or desirable, muffled using sound insulation elements. Besides hoods, plates (preferably perforated) which are connected to elements which are formed of muffling material are also provided as sound insulation elements. Fiberglass and foam are suggested muffling materials. What is known as anti-drone material is applied to the walls of the printing machine to attenuate structure-borne noise.

The German Utility Model (DE-GM) 7 325 088 discloses a buckle folding device having a folding unit wherein paper sheets are processed. The paper sheets slide with the aid of transport cylinders along sheet guide rails which are disposed in so-called buckle plates or folding pockets. The buckle plates are surrounded by a swinging multipartite sound insulation mechanism that virtually encapsulates the folding unit. The sound insulation mechanism is formed of steel panel walls which are covered on the exterior side by an open-pored muffling material. In turn, the muffling material is sealed on the interior side by a dustproof foil.

SUMMARY OF THE INVENTION

It is accordingly an object of the invention to provide, by a simple and most economical construction, an optimally effective reduction of the noise emissions arising at the impression cylinder during printing of the flat material.

With the foregoing and other objects in view, there is provided, in accordance with one aspect of the invention, a device for reducing the noise emissions of a machine for printing flat material, wherein flat material is transportable across an impression cylinder, comprising at least one muffling element disposed across a portion of a transport path of the flat material extending along the impression cylinder, directly behind or downline from a nip, as viewed in the direction of the transport path, and at a spaced distance from the impression cylinder.

In accordance with another feature of the invention, the muffling element serves for shielding the nip on at least one side of the transport path of the flat material.

In accordance with a further feature of the invention, the muffling element is affixed to a bearing element.

In accordance with an added feature of the invention, the bearing element is movably mounted.

In accordance with an additional feature of the invention, the bearing element has a hollow interior wherein the muffling element is disposed.

In accordance with yet another feature of the invention, the bearing element is rigid with a footstep for accessing the machine.

In accordance with yet a further feature of the invention, the footstep is pivotably mounted.

In accordance with yet an added feature of the invention, the bearing element comprises a baffling arrangement which is connected to the muffling element.

In accordance with yet an additional feature of the invention, the bearing element is constructed as a baffling arrangement connected to the muffling element.

In accordance with still another feature of the invention, the bearing element is constructed at least partly as a muffling element.

In accordance with still a further feature of the invention, the bearing element comprises a guide element for the flat material, and a muffling element is arranged on a side of the guide element facing away from the impression cylinder.

In accordance with still an added feature of the invention, the bearing element is formed by a perforated plate at least approximately following the curvature of the surface of a jacket of the impression cylinder.

In accordance with still an additional feature of the invention, the device comprises a lateral part for covering an interspace between the muffling element and the impression cylinder at least on one side of the transport path of the flat material.

In accordance with another feature of the invention, the bearing element comprises a lateral part for shielding the impression cylinder at least at one end face thereof.

In accordance with a further feature of the invention, the bearing element comprises a lateral part for shielding a nip on at least one side of the transport path of the flat material.

In accordance with an added feature of the invention, the muffling element is disposed at the lateral part.

In accordance with another aspect of the invention, there is provided a machine for printing flat material, wherein flat material is transportable across an impression cylinder, including a device for reducing the noise emissions of the machine, comprising at least one muffling element disposed across a portion of a transport path of the flat material extending along the impression cylinder, directly behind or downline from a nip, as viewed in the direction of the transport path, and at a spaced distance from the impression cylinder.

In accordance with a concomitant feature of the invention, the machine for printing flat material is an offset printing machine.

The object of the invention is achieved by providing a device for reducing noise emissions wherein at least one muffling element is disposed across a portion of the transport path of the flat material, which extends along the impression cylinder, directly behind a nip and spaced a distance from the impression cylinder.

The portion of the transport path of the flat material which is provided with a sound insulation element is situated directly behind the nip (as viewed in the transport direction) between the impression cylinder and an ink applicator or depositing element, the flat material being transportable through the nip. A portion of the transport path of the flat material extending along the impression cylinder is shielded by at least one muffling element that is disposed at a slight distance from the impression cylinder. The muffling element is preferably arranged so that the flat material that is guided across the impression cylinder can be transported—through between the muffling element and the impression cylinder, and at the same time the noise that is generated and emitted during the printing of the flat material can immediately be dissipated to a considerable extent in the muffling element that is disposed adjacent the impression cylinder. Specifically, this prevents the generated airborne noise from reaching other components and from propagating. Such a muffling element expediently extends at least over the entire width of the flat printing material and over an appreciable distance along the transport path of the flat material. In this way, it is possible to achieve a particularly effective attenuation of the noise that is generated in the printing of the flat material, because the muffling element is disposed directly behind the nip, i.e., the locus of the noise generation.

In a development of the invention, the nip is shielded by a muffling element on at least one side of the transport path of the flat material. Preferably, in addition to a first muffling element which covers the entire width of the transport path of the flat material, one or more additional muffling elements extend over the height of the interspace between the first sound insulation element and the impression cylinder along the sides of the transport path of the flat material. The muffling elements can be affixed to the interior surfaces of the sidewalls of the printing machine or to separate bearing elements. A still improved sound insulation can be achieved using lateral muffling elements.

In another development of the invention, a muffling element is affixed to a bearing element that is mounted in a movable manner. The bearing element is preferably connected to or constructed in one piece with the printing machine structure and is sufficiently rigid as to permit the utilization of elastic and less rigid materials for the muffling element. The bearing element and the muffling element can form a multiayered composite that has a sufficient rigidity and good noise insulation characteristics. The muffling element can be affixed to the side of the bearing element that faces the impression cylinder and/or the side of the bearing element that is averted from the cylinder. If the muffling element is disposed on the side facing the impression cylinder, and if in addition the flat material is constructed in the form of individual sheets, the muffling element preferably stands at a sufficient spaced distance from the impression cylinder as to prevent the sheets from contacting the muffling element as they disengage from the impression cylinder.

In another embodiment of the invention, the bearing element surrounds a hollow space wherein a muffling element is disposed. Advantageously, the bearing element is constructed as a hollow or U-shaped plate profile with the muffling element inserted in the hollow interior or cavity thereof.

In a preferred development of the invention, the bearing element is constructed in one piece with or is connected to a footstep (specifically a pivoting footstep) for accessing the printing machine. The muffling element can thus be integrated into the existing structure of the printing machine particularly well. A particularly advantageous mechanism for fastening the muffling element is produced when the muffling element, together with the footstep and the bearing element, is arranged in a swinging manner, because the impression cylinder can be accessed rather easily by the operating personnel by swinging the muffling element out or away.

According to another development of the invention, the bearing element comprises or is constructed as a baffling arrangement that is connected to the muffling element. A perforated plate or some other partly sound-permeable structure is provided as the baffling arrangement. Either the whole bearing element or part thereof can be constructed as a baffling arrangement, and either the whole baffling arrangement or parts thereof can be connected to a muffling element. The muffling element can be affixed to the side of the baffling arrangement that faces the impression cylinder and/or to the side that is averted from the impression cylinder.

The bearing element is preferably constructed at least in part as a muffling element. The bearing element thus takes over all or part of the muffling and sound-damping tasks. In this embodiment, the bearing element is advantageously constructed as a microporous rigid structure with a high stability. The bearing element may, but need not, be provided with an additional muffling element.

In another embodiment of the invention, the bearing element has a guide element for the flat material, at which a muffling element is arranged on the side that is averted from the impression cylinder. The guide element serves to guide the flat material, namely the individual sheets, and expediently forms a baffling arrangement that is semi-permeable to sound, and forms a sound insulation device together with the muffling element.

A preferred development of the invention provides that the bearing element be formed by a perforated plate which at least approximately follows the curvature of the surface of the jacket of the impression cylinder. A plate which is constructed in this way can be applied closely to the impression cylinder, so that it can effectively prevent individual sheets of the flat material from disengaging too far. Using a perforated plate, it is possible to realize a baffling arrangement that is particularly easy to produce and that can simultaneously serve as a sheet guiding element. In this case, a muffling element can be attached in a protected manner to the side of the plate that is averted form the impression cylinder. The plate and the muffling element thus together form an effective sound insulation device.

In another development of the invention, the bearing element comprises a parallel arrangement of sheet guide rails which at least approximately follow the curvature of the jacket of the impression cylinder. Such sheet guide rails are particularly easy to produce. They can effectively prevent individual sheets of the flat material from disengaging too far from the impression cylinder. In addition, because of the baffling properties thereof, they also serve as a baffling arrangement, and because of the rigidity thereof, as a bearing element for a muffling element that is arranged thereon on the side that is averted from the impression cylinder.

The bearing element preferably comprises a lateral part that covers the interspace between the muffling element and the impression cylinder to the side of the transport path of the flat material. A lateral part is preferably arranged on each side of the transport path of the flat material. The lateral parts are disposed between the muffling element and the jacket of the impression cylinder and form components of a baffling arrangement that shields the transport path of the flat material both above and at the side.

In another development of the invention, the bearing element comprises a lateral part that shields the impression cylinder at an end face thereof. Preferably, a lateral part is disposed on each side of the transport path of the flat material. The lateral parts surround the impression cylinder at the end faces thereof as well and effectuate a particularly effective baffling.

The bearing element preferably comprises a lateral part that shields the nip on one side of the transport path of the flat material. A lateral part is expediently disposed on each side of the nip. The lateral parts surround the impression cylinder as well as the ink applicator or depositing element, which is preferably constructed as a rubber blanket, in the region of the nip, thereby effectuating a particularly effective baffling.

In a further development of the invention, a muffling element is disposed at the lateral part. The muffling element can be disposed at the interior surface of the lateral part, which faces the impression cylinder, or at the exterior surface thereof, which is averted from the impression cylinder.

The subject matter of the invention also comprises a machine for printing flat material, particularly an offset printing machine, in which the device for reducing noise emissions in accordance with the invention is provided.

Other features which are considered as characteristic for the invention are set forth in the appended claims.

Although the invention is illustrated and described herein as embodied in a device for reducing noise emissions, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
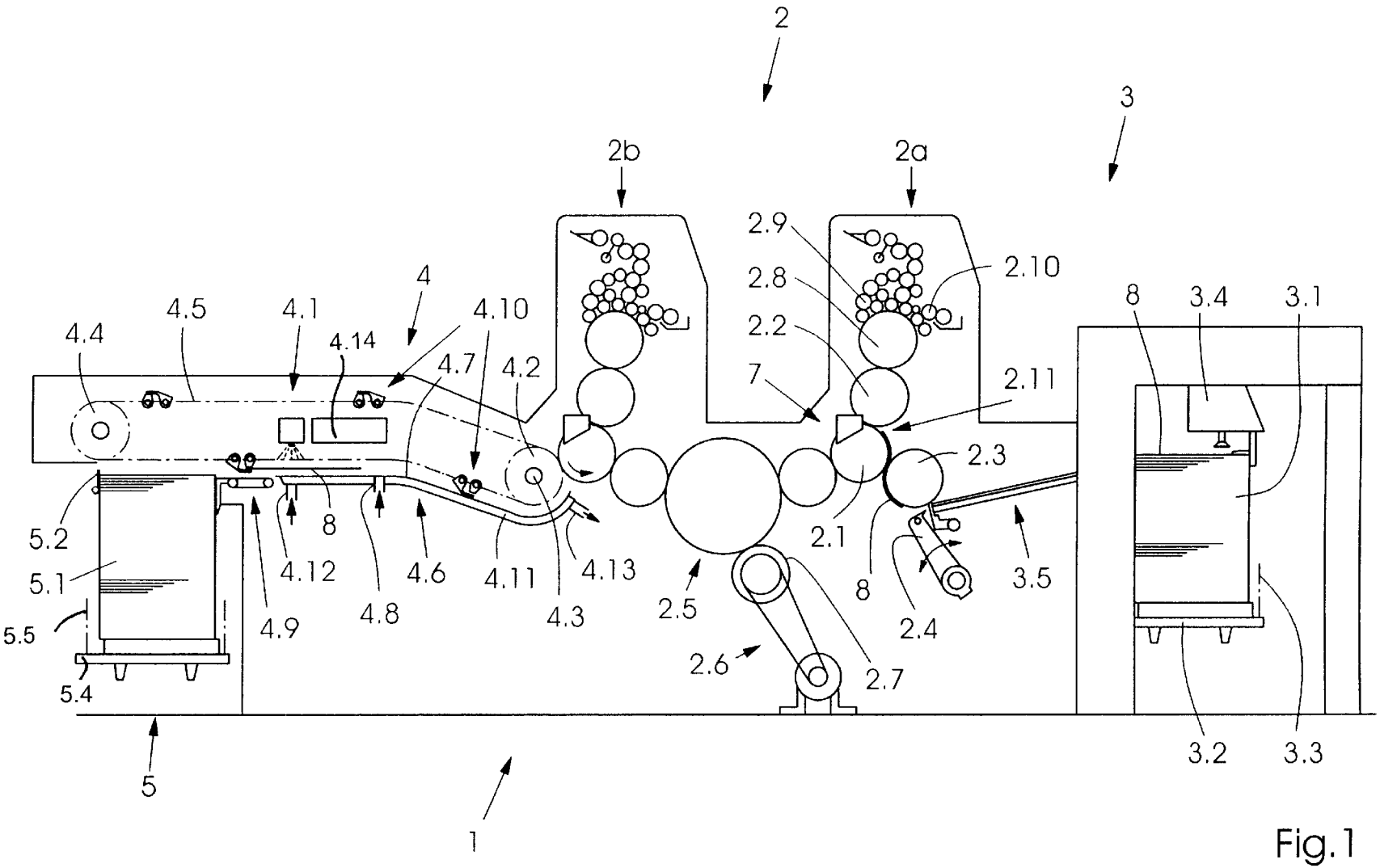
FIG. 1 is a diagrammatic side elevational view of an embodiment of a printing machine for processing flat material, in the form of an offset press, which is incorporated with the device for reducing noise emissions in accordance with the invention.

Referring now to the drawings and, first, particularly to FIG. 1 thereof, there is shown therein in a diagrammatic view, a printing machine 1 for printing flat material. Specifically, paper sheets 8 are provided as the flat printing material. The machine 1 comprises a printing press 2, a paper-supplying device 3 in the form of a feeder, which is disposed at the input side of the machine 1, a delivery 4 having a chain conveyor 4.1, which is disposed at the output of the printing machine 2, and a sheet stacking or pile station 5 that is disposed below an end region of the chain conveyor 4.1.

The paper feeder 3 includes a platform 3.2 bearing a pile 3.1 of paper. A lifting unit is provided for lifting the platform 3.2 incrementally in correspondence with the withdrawal of sheets from the pile 3.1, by lifting chains 3.3, shown in phantom, from which the platform 3.2 is suspended. Above the pile 3.1, a separating or singling unit 3.4 having lifting and pulling or dragging suckers is provided for grasping the respective top sheet of the pile 3.1 and delivering that sheet to a transport unit 3.5 realized as a suction belt conveyor for aligning the respective sheets at the leading edge thereof and at a side edge thereof for forwarding purposes.

The printing machine 2, in the exemplifying embodiment of FIG. 1, is a rotary printing machine operating in accordance with the offset method, and comprising two printing units 2*a* and 2*b* having respective inking systems 2.9. It is thus equipped for printing in two colors. To print in additional colors, another printing unit must be provided for each respective color.

The printing unit 2*a* includes an impression cylinder 2.1 and a feeding drum 2.3 for transferring the sheets 8 which must be printed in the respective printing unit to the impression cylinder 2.1. An ink applicator or depositing element in the form of a rubber blanket cylinder 2.2 rolls on the impression cylinder 2.1, and a printing form cylinder 2.8 rolls on the rubber blanket cylinder, in turn. In the region of a nip 2.11 between the impression cylinder 2.1 and the rubber blanket cylinder 2.2 through which the flat material is transported, a device 7 (a sound insulation device) is provided for reducing the noise emissions which are generated in the course of printing the flat material. This device is described in detail hereinbelow.

The printing unit 2*b* is equipped with corresponding devices.

A pre-gripper 2.4 which is disposed between the transport unit 3.5 and the feeding drum 2.3 picks up a sheet that is supplied by the transport unit 3.5 and transfers it to the feeding drum 2.3, which then delivers it to the impression cylinder 2.1 of the first printing unit 2*a*.

A sheet transfer device 2.5 is provided between the printing units 2*a* and 2*b*. If two printing units, which are connected by such a sheet transfer device, print the same side of a sheet with different colors, the sheets 8 are delivered thereby without being reversed or turned; if two printing units that are connected by such a sheet transfer device, respectively, print a different side of a sheet 8, then the corresponding sheet transfer device is constructed so that the sheets are delivered to the second printing unit after being reversed or turned.

For operation, a drive 2.6 is provided, which has a motor-driven belt drive and an output gear 2.7, which meshes with a gear of the sheet transfer device 2.5. In the exemplary embodiment, the sheet conveyor 2.4 and the lifting unit of the paper feeder 3 are also cooperatively connected with the drive 2.7, so that, when the respective printing unit 2*a*, 2*b* is shut down, a shutdown of the other components which contribute to supplying the printing machine with sheets and transporting them is effectuated as well.

The sheets that are printed in the printing machine 2 are likewise transferred to the chain conveyor 4.1 of the delivery 4, which is also cooperatively connected with the drive 2.6. To this end, drive sprockets 4.2 are provided, which enjoy a driving connection with a gear train that drives the cylinder of the respective printing units 2*a* and 2*b*, the respective feeding drum 2.3, and the sheet transfer device 2.5, and that forms a side strand in the respective printing unit 2*a*, 2*b*. In the diagrammatic representation of FIG. 1, gears are represented in the same manner as drums which are connected to the respective gears, and as cylinders which are connected to the respective gears and drive sprockets 4.2 which are connected to the gears and affixed to a common sprocket shaft 4.3.

The chain conveyor 4.1 comprises conveyor chains 4.5 which are guided between the drive sprockets 4.2 and guide or reversing sprockets 4.4 by chain guide rails and which revolve along respective sidewalls of the discharge device 4. Each conveyor chain 4 is looped around one of two synchronously driven drive sprockets 4.2 having rotational axes which are flush with one another, and is guided, in the illustrated embodiment, by a guide sprocket 4.4, which is located downline from the drive sprockets 4.2 relative to the processing direction. Gripper systems 4.10 which are borne by the two conveyor chains 4.5 extend therebetween. In the example at hand, the sheets 8 are transported by the bottom strand of the chain in FIG. 1. This section of the chain path that is traversed by the sheets is followed by a sheet guide surface 4.7 facing that chain path section, the sheet guide surface 4.7 being an inwardly facing surface of a sheet guide unit 4.6. Between the latter and the sheet 8 that is guided thereover, a bearing air cushion is preferably realized. To this end, the sheet guide unit 4.6 is equipped with blast air jets 4.8 that open into the sheet guide surface 4.7, one of which is symbolically shown in FIG. 1 as representative of all such jets.

To prevent the sheet guide surface 4.7 from overheating under the influence of a drier 4.14, a coolant circuit is integrated into the sheet guide unit 4.6, which is symbolically indicated in FIG. 1 by an inlet nozzle 4.12 and an outlet nozzle 4.13 on a coolant tank 4.11 that is disposed at the sheet guide surface 4.7. A sheet brake 4.9 comprises a plurality of brake modules, which are formed by respective suction belt or tape conveyors.

The sheets 8 are transferred from the chain conveyor 4.1 to the stacking or pile station 5, so that a pile 5.1 of sheets forms thereat. The stacking or pile station 5 comprises a front or leading edge stop 5.2 and a non-illustrated opposite rear or trailing edge stop for the sheets in an upper receiving region thereof, by which the sheets are aligned. The stacking or pile station 5 also includes a lifting unit, of which only a platform 5.4 bearing the pile 5.1, and lifting chains 5.5 bearing the platform 5.4 are shown in FIG. 1, the lifting chains 5.5 being represented in phantom.

The printing machine 1 operates in the following manner: A sheet 8 that is to be processed is removed from the pile 3.1 by the singling or separating unit 3.4 and transferred to the transport unit 3.5. The latter transfers the sheet 8 to the pre-gripper 2.4, as mentioned above, which guides it to the feeding drum 2.3, in turn. Via the feeding drum 2.3, the sheet 8 is transported to the impression cylinder 2.1, with the transport path of the sheet leading between the impression cylinder 2.1 and the rubber blanket 2.2 through the nip, where the ink that is processed in the printing unit 2*a* is transferred onto the sheet. Next, the sheet 8 moves via the sheet transfer device 2.5 to the next printing unit 2*b*, where it is printed with another ink. At the end of the printing unit 2*b*, the sheet 8 is transferred to a gripper system 4.10 of the chain conveyor 4.1, the gripper system 4.10 passing the last impression cylinder. For a sheet 8 that is provided for storage in the pile 5.1, the respective gripper system 4.10 opens over a sheet brake 4.9 in order to transfer the sheet 8 thereto. The sheet brake 4.9 takes the sheet 8 down to a reduced output speed compared to the processing speed, and releases it when it has attained the output speed, so that a correspondingly decelerated sheet 8 ultimately contacts the front or leading edge stops 5.2 in the pile or stacking station 5, so that, after being aligned at the stops, the sheet, together with preceding and/or succeeding sheets, forms the pile 5.1 which is lowered as it grows.

In the various processing steps of the sheet 8, noises that are excited by airborne and structure-borne sounds are generated and sent into the environment. The dispersal of the noise emissions can be counteracted by various secondary sound insulation measures related for the most part to the exterior walls of the machine 1, i.e. to the printing units 2*a* and 2*b*, as is generally known. But if a further reduction of the noise emissions is desired, then non-specific sound insulation measures are insufficient. In accordance with the invention, a device 7 for the purposeful reduction of the noise emissions is provided in the region of the nip between the impression cylinder 2.1 and the rubber blanket cylinder 2.2 serving as an ink applicator or depositing element, this device 7 serving to counteract what is known as the tearing noise of the sheets 8 (paper tearing noise) at the output of the nip 2.11.

Figure 2:
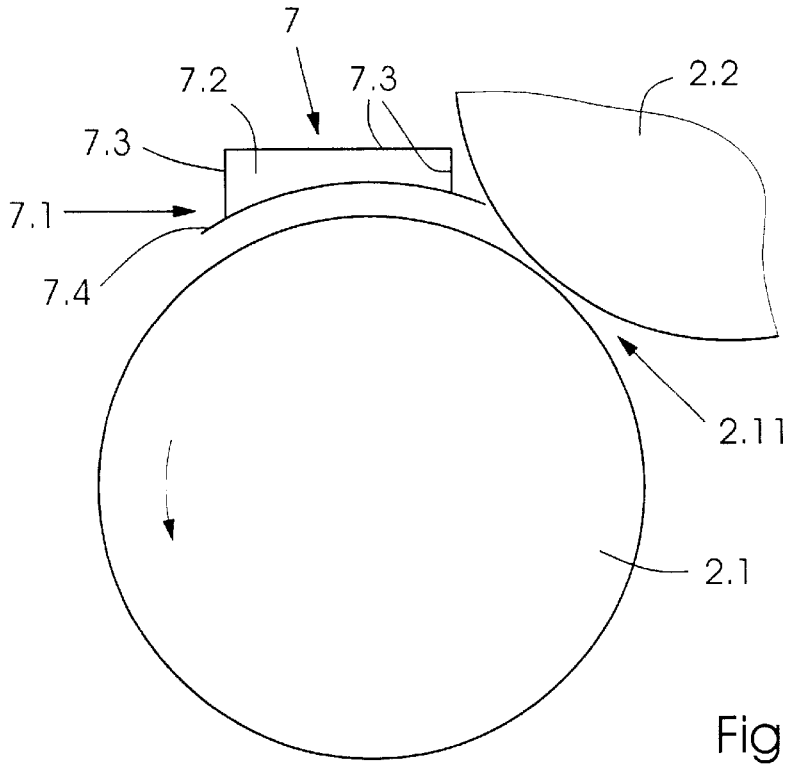
FIGS. 2 to 5 are enlarged fragmentary views of FIG. 1 showing different embodiments of the device for reducing noise emissions according to the invention.

FIG. 2 is a diagrammatic side elevational view of a first exemplary embodiment of the device 7 for reducing the sound emissions in the region of the nip 2.11 (sound insulation device). The sound insulation device 7 is disposed directly behind or downline of the nip 2.11 as viewed in the direction of transport of the sheets 8. The device 7 includes a bearing element 7.1, which extends along the transport path of the sheets at a slight distance from the impression cylinder 2.1 across a circumferential portion of the jacket surface thereof and which at least approximately follows the curvature of this surface. The sound insulation device 7 and the bearing element 7.1 expediently extend over the entire width of the impression cylinder 2.1. In a modified exemplary embodiment, the sound insulation device extends at least over the width of the transported sheets 8.

The bearing element 7.1 includes a perforated plate 7.4, which simultaneously serves as the sheet guide element in that, due to the close distance thereof to the impression cylinder 2.1, it prevents the sheets 8 from disengaging from the impression cylinder 2.1. Due to the perforations formed therein, the plate 7.4 has a defined, optimizable proportion of holes and thus functions as a baffling arrangement, in part reflecting and in part passing the airborne sound that is generated at the nip 2.11. The proportion of holes in the plate is advantageously as large as possible.

A muffling element 7.2 which is installed on the side of the perforated plate 7.4 that is averted from the impression cylinder 2.1 muffles the sound traveling through the plate 7.4. The muffling element 7.2 is produced from a porous, sound-absorbent muffling material such as foam or mineral wool, and is connected to the plate 7.4 and enclosed between additional plates 7.3. Together with the perforated plate 7.4, the plates 7.3 can form a bearing element 7.1 that is constructed as a baffling arrangement and that is particularly rigid, the muffling element 7.2 being installed in the hollow interior thereof. To this end, the plates 7.4 and 7.3 are permanently connected to one another or are constructed in one piece. In another development, they are connected so that they may be disassembled, thereby enabling a change or replacement of the muffling element 7.2. In particular, the muffling element 7.2 is surrounded by the bearing element 7.1 in a soundproof manner.

Figure 3:
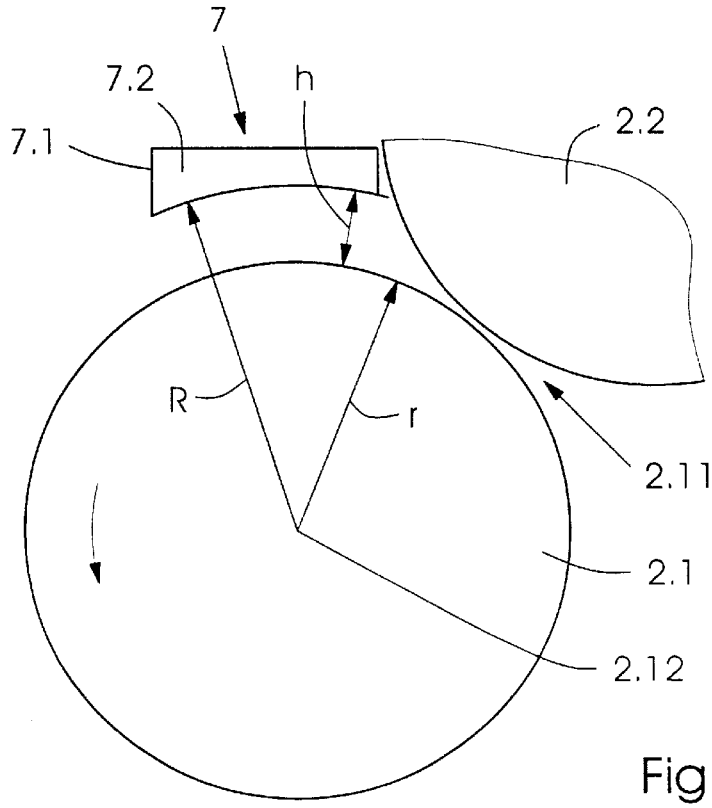

FIG. 3 is a view like that of FIG. 2 showing a second exemplary embodiment of the device 7 for reducing noise emissions (sound insulation device) according to the invention in the region of the nip 2.11. Components with the same function as those in the first exemplary embodiment have the same reference characters as in FIG. 1. The sound insulation device 7 includes a muffling element 7.2, which is again formed of a sound-absorbent and sound-dissipating material, and a U-shaped bearing element 7.1, which surrounds the muffling element 7.2 on several sides, with the muffling element being arranged on the side of the bearing element 7.1 which faces the impression cylinder 2.1. The distance h between the sound insulation device 7 and the surface of the jacket of the impression cylinder 2.1 is defined so that a sheet 8 cannot make contact with the muffling element 7.2 when disengaging from the impression cylinder 2.1 (note FIG. 3).

The inner surface of the muffling element, which faces the impression cylinder 2.1, expediently formed with an arched shape having a radius R relative to the bearing axle 2.12 of the impression cylinder 2.1 which is greater than the radius r of the impression cylinder 2.1 by the amount h. In a modified exemplary embodiment, the muffling element 7.2 is also surrounded below by a baffling arrangement.

Figure 4:
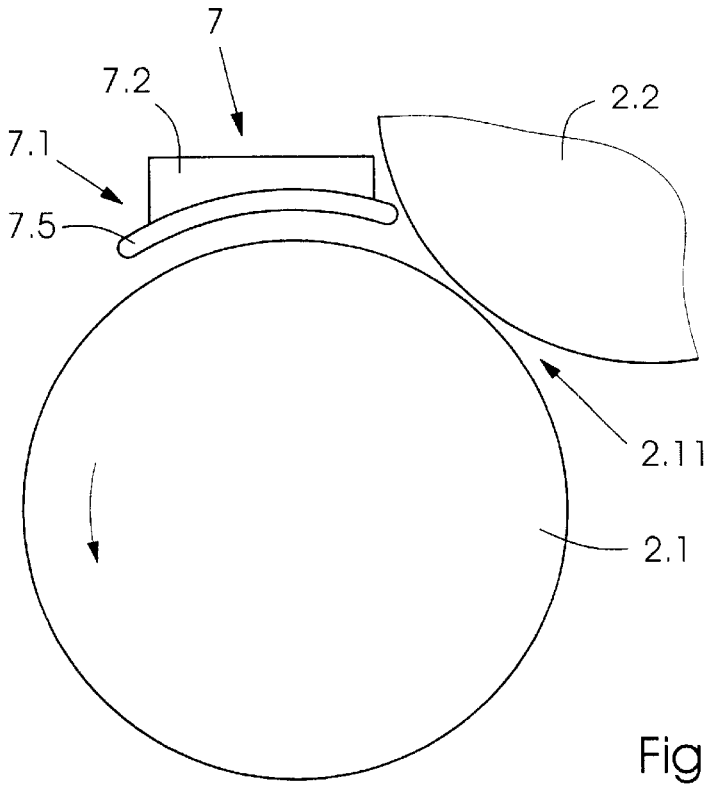

FIG. 4 is a view like those of FIGS. 2 and 3 showing a third exemplary embodiment of the inventive sound insulation device 7. The sound insulation device 7 includes a muffling element 7.2, which is affixed to a bearing element 7.1 that is constructed in the form of several parallel, particularly rigid, sheet guide rails 7.5, on the side that is averted from the impression cylinder 2.1. The sheet guide rails 7.5 are advantageously curved, are closely adjacent to the impression cylinder 2.1, and are oriented in the direction of transport of the sheets 8, so that they prevent the sheets 8 from disengaging from the impression cylinder 2.1 along a long portion of the transport path thereof at the impression cylinder 2.1. The sheet guide rails 7.5 are disposed directly behind or downline from the nip 2.11 and function as a baffling arrangement in that they partially reflect the airborne sound. The muffling element can be surrounded by baffle plates on all sides, with the exception of the side facing the sheet guide rails 7.5 and the impression cylinder 2.1.

Figure 5:
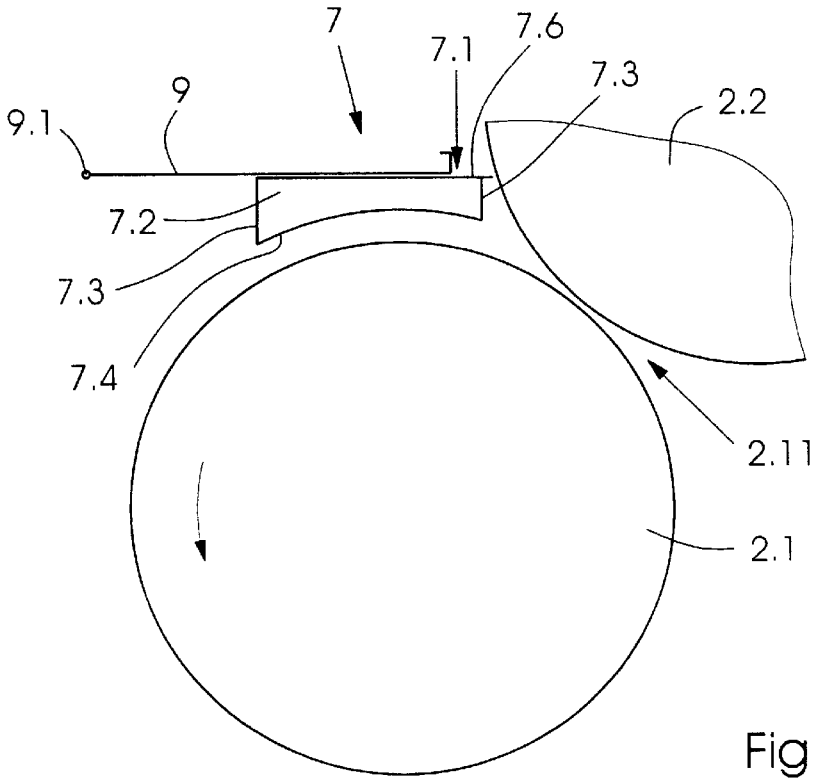

FIG. 5 is a view like those of FIGS. 2 to 4 showing a fourth exemplary embodiment of the sound insulation device 7 according to the invention. The sound insulation device 7 includes a muffling element 7.2, which is affixed to a bearing element 7.1 formed of a holding part 7.6, a perforated sheet guide plate 7.4, and lateral plates 7.3. The holding part 7.6 and the plates 7.3, 7.4 are affixed to a footstep 9 that is mounted so as to pivot about a bearing axis 9.1, so that the overall sound insulation device 7 together with the footstep 9 can be swung out or away from the impression cylinder 2.1. Furthermore, lateral muffling elements not illustrated in FIG. 5 are provided as components of the sound insulation device 7, those lateral muffling elements being oriented parallel to the end faces of the impression cylinder 2.1 and being affixed to the holding part 7.6 so that they, together with the footstep 9 can be pivoted away. The lateral muffling elements shield the transport path of the sheets 8 laterally and can also be disposed in a stationary manner at fixed sidewalls of the printing unit 2*a* and 2*b*.

Figure 6B:
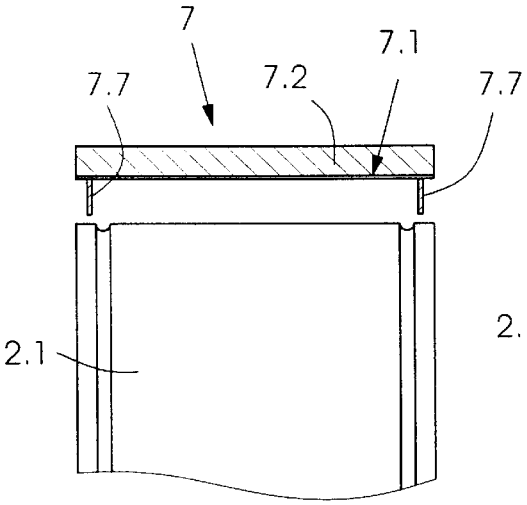
FIG. 6*b* is a cross-sectional view of FIG. 6*a* taken along the line VI—VI in the direction of the arrows.
Figure 6A:
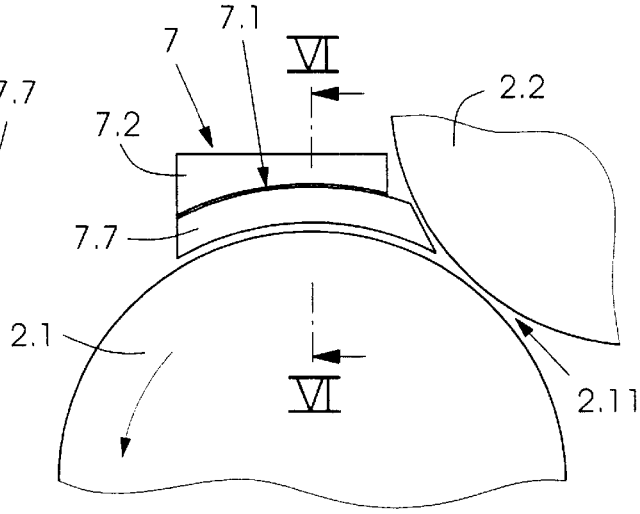
FIG. 6*a* is a view like those of FIGS. 2 to 5 of another embodiment of the device for reducing noise emissions according to the invention.

Another exemplary embodiment of the sound insulation device 7 according to the invention is represented in FIGS. 6*a* and 6*b*. The sound insulation device 7 includes all or nearly all of the elements of one of the aforedescribed exemplary embodiments. Specifically, a bearing element 7.1 and a muffling element 7.2 are provided and disposed directly behind or downline of the nip 2.11 as viewed in the direction of transport of the sheets 8, at a slight spaced distance from the impression cylinder 2.1, and which shield the transport path of the sheets 8 from above. In addition, lateral parts 7.7 are provided on both sides of the transport path of the sheets 8, which serve to encapsulate the transport path of the sheets extending along the impression cylinder and to shield it laterally. The lateral parts 7.7 extend over the measuring rings of the impression cylinder 2.1 between the muffling element 7.2 and the jacket surface of the impression cylinder 2.1, from which they are spaced a slight distance, so that there is no contact between the stationary lateral parts and the rotating impression cylinder 2.1. The lateral parts are connected to the bearing element 7.1 and form an effective baffling arrangement together with additional parts of the bearing element 7.1. To this end, lateral parts 7.7 can be constructed either as perforated plates or as completely solid plates. In a modified exemplary embodiment, additional muffling elements are attached to outer surfaces of the lateral parts, which surfaces are averted from the transport path of the sheets 8, and/or to inner surfaces which face the transport path of the sheets 8.

In another modified exemplary embodiment, the muffling element 7.2 extends over the lateral parts and is U-shaped, accordingly.

Figure 7B:
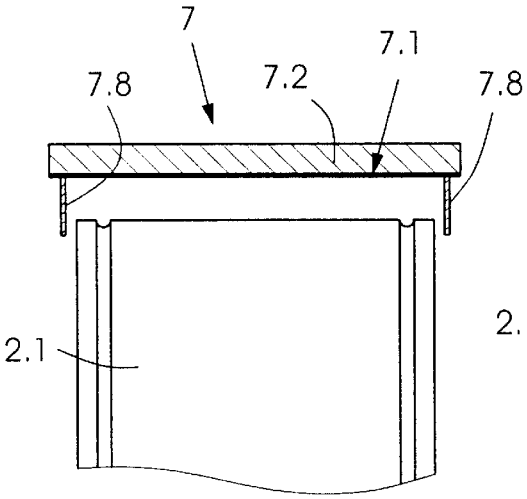
FIG. 7*b* is a cross-sectional view of FIG. 7*a* taken along the line VII—VII in the direction of the arrows.
Figure 7A:
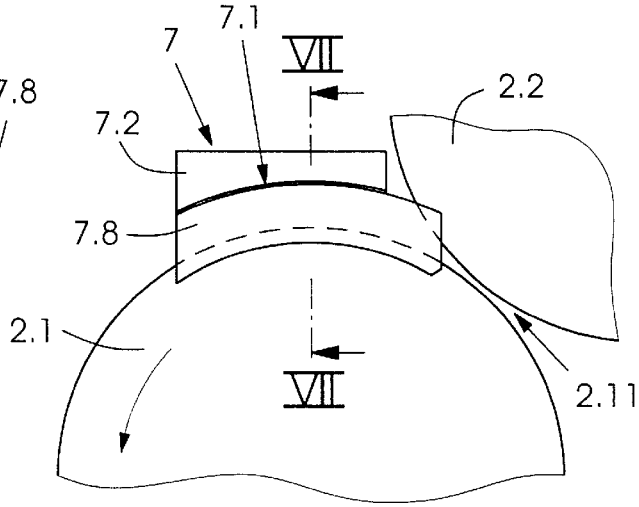
FIG. 7*a* is a view like those of FIGS. 2 to 5 and 6*a* of a further embodiment of the device for reducing noise emissions according to the invention.

In FIGS. 7*a* and 7*b*, another particularly preferred exemplary embodiment of the sound insulation device 7 according to the invention is shown. The structure of the sound insulation device 7 at least approximately corresponds to that of the embodiment represented in FIGS. 6*a* and 6*b*; namely, a bearing element 7.1 and a muffling element 7.2 are provided, which shield the transport path of the sheets extending along the impression cylinder. However, lateral parts 7.8 are provided on both sides of the transport path of the sheets 8, which partially cover both the impression cylinder 2.1 and the rubber blanket cylinder 2.2 at the end face thereof. In addition, the lateral parts 7.8 also shield the nip 2.11. The lateral parts are connected to the bearing element 7.1 and advantageously form a particularly effective baffling arrangement together with the other parts of the bearing element 7.1. The lateral parts 7.8 can also be completely solid plates. Sound-absorbent material can be provided on the inside. In a modified exemplary embodiment, if the lateral parts 7.8 are constructed as perforated plates, they are provided with additional muffling elements at the outer surfaces thereof that are averted from the transport path of the sheets 8.

In a non-illustrated modified exemplary embodiment, the bearing element is constructed as a rigid microporous disk or plate and, thus, simultaneously serves as a muffling element and a sheet guiding element. In this case, a separate muffling element can be dispensed with. It is also possible to combine any of the features that are realized in the hereindescribed embodiments. In particular, damped lateral parts and a soundproof encapsulation of the bearing element which is constructed as a muffling element can also be provided.

The device according to the invention for reducing the noise emissions of a printing machine for printing flat material in the form of paper sheets makes possible an effective attenuation and elimination of noise by the muffling element in the region of the impression cylinder and the nip. A dispersion of sound emissions, particularly of what is known as the paper tearing noise, which cannot be prevented by primary measures is purposefully prevented in that a muffling element is attached directly at the locus of noise generation; i.e.; behind or around the nip, and shields the transport path of the transported sheets of paper. Both baffling and muffling arrangements are provided, which in combination make possible a sound insulation system that can be optimally adapted to the given installation conditions in a printing machine. A pivoting bearing of the inventive sound insulation device ensures that operating personnel have relatively easy access to the printing elements of the machine.

A printing machine that is equipped with the inventive sound insulation device has a particularly low level of operating noise.

We claim:

1. A sheet fed rotary printing unit through which sheets pass in a processing direction along a conveying path, comprising:

an impression cylinder having a sheet bearing surface;

a blanket cylinder, said blanket cylinder and said impression cylinder forming an impression nip, a first wedge-shaped space, with respect to the processing direction, upstream from said impression nip, and a second wedge-shaped space downstream from said impression nip; and at least one muffling element disposed within said second wedge-shaped space.

2. The printing unit according to claim 1, wherein said muffling element serves for shielding said second wedge-shaped space.

3. The printing unit according to claim 1, including a bearing device supporting said muffling element.

4. The printing unit according to claim 3, wherein said bearing device is movably mounted.

5. The printing unit according to claim 3, wherein said bearing device has a hollow interior wherein said muffling element is disposed.

6. The printing unit according to claim 3, including a footstep for accessing the printing unit, said footstep forming said bearing device.

7. The printing unit according to claim 3, wherein said bearing device is pivotally mounted.

8. The printing unit according to claim 3, wherein said bearing device includes a baffling assembly including said muffling element.

9. The printing unit according to claim 3, wherein said bearing device is constructed as a baffling assembly including said muffling element.

10. The printing unit according to claim 3, wherein said muffling element at least partly forms said bearing device.

11. The printing unit according to claim 3, wherein said bearing device includes a guide element for the sheets, and said muffling element is disposed on a side of said guide element facing away from said impression cylinder.

12. The printing unit according to claim 3, wherein said bearing device is formed by a perforated plate at least approximately following the curvature of said sheet bearing surface of said impression cylinder.

13. The printing unit according to claim 3, wherein said bearing device includes parallel sheet guide rails at least approximately following the curvature of said sheet bearing surface of said impression cylinder.

14. The printing unit according to claim 3, wherein said bearing device includes a lateral part for covering an interspace between said muffling element and said impression cylinder at least at one side of the conveying path.

15. The printing unit according to claim 3, wherein said bearing device includes a lateral part for shielding said impression cylinder at least at one end face thereof.

16. The printing unit according to claim 3, wherein said bearing device includes a lateral covering part for shielding said nip at least at one side of the conveying path.

17. The printing unit according to claim 16, including a further muffling element disposed at said lateral covering part.

18. A sheet fed rotary offset printing machine having at least one printing unit through which sheets pass in a processing direction along a conveying path, the printing unit comprising:

an impression cylinder having a sheet bearing surface;

a blanket cylinder, said blanket cylinder and said impression cylinder forming an impression nip, a first wedge-shaped space, with respect to the processing direction, upstream from said impression nip, and a second wedge-shaped space downstream from said impression nip; and at least one muffling element disposed within said second wedge-shaped space.

19. The printing unit according to claim 3, including a footstep for accessing the printing unit, said bearing device being attached to said footstep.

* * * * *